United States Patent [19]

Liautaud

[11] 4,255,735

[45] Mar. 10, 1981

[54] PRECISION INJECTION-MOLDED COIL FORM

[76] Inventor: James P. Liautaud, River and Bluff Rds., Trout Valley, Cary, Ill. 60013

[21] Appl. No.: 860,872

[22] Filed: Dec. 15, 1977

Related U.S. Application Data

[63] Continuation of Ser. No. 766,388, Feb. 7, 1977, abandoned, which is a continuation of Ser. No. 639,421, Dec. 10, 1975, abandoned.

[51] Int. Cl.[3] ..... H01F 15/10; H01F 27/30

[52] U.S. Cl. ..... 336/192; 264/251; 264/272; 264/274; 336/208; 343/715; 343/749; 343/888

[58] Field of Search ..... 343/715, 888, 900, 905, 343/906, 749; 174/153 A, 178, 179, 209; 336/198, 208, 205, 200, 192, 107, 136; 264/271, 272, 275, 259, 328

[56] References Cited

U.S. PATENT DOCUMENTS

| | | | |
|---|---|---|---|
| 2,289,197 | 7/1942 | Jones | 174/178 |
| 2,771,604 | 11/1956 | Goldstein | 343/888 X |
| 2,884,661 | 2/1953 | Hurley | 264/275 |
| 2,924,643 | 2/1960 | Barnes | 174/178 |
| 2,938,210 | 5/1960 | Harris | 343/900 X |
| 2,966,678 | 12/1960 | Harris | 343/900 X |
| 3,166,751 | 1/1965 | Roll | 174/153 A X |
| 3,185,947 | 5/1965 | Freymodsson | 336/200 |
| 3,267,476 | 8/1966 | Finke | 343/715 |
| 3,281,744 | 10/1966 | Melanson | 336/136 X |
| 3,408,652 | 10/1968 | Allisbaugh | 343/715 |
| 3,486,149 | 12/1969 | Klein | 336/200 X |
| 3,590,329 | 6/1971 | Krepps, Jr. | 336/208 X |

OTHER PUBLICATIONS

James Liautaud "Designing Components for Bi Plastic Insert Molding", Plastics Design & Processing, Mar., 1972, pp. 13–16.

*Primary Examiner*—Thomas J. Kozma
*Attorney, Agent, or Firm*—Lockwood, Dewey, Alex & Cummings

[57] ABSTRACT

A high-precision injection-molded form for an inductance coil comprises a cylindrical core formed of a solid mass of plastic or similar material which has a surface of relatively low dimensional precision. A thin plastic layer molded over the surface of the core provides a high precision surface including helical grooves in which the windings of the coil are seated.

3 Claims, 6 Drawing Figures

PRECISION INJECTION-MOLDED COIL FORM

This is a continuation of application Ser. No. 766,388, filed Feb. 7, 1977, now abandoned, which is a continuation of application Ser. No. 639,421, filed Dec. 10, 1975, now abandoned.

BACKGROUND OF THE INVENTION

This invention relates generally to coil forms, and more particularly to coil forms having surfaces of high dimensional accuracy on which windings can be positioned with great accuracy.

In manufacturing certain types of electronic equipment such as radio frequency transmitters and receivers the need exists for inductance coils which can be economically manufactured in large quantities with consistent and predictable electrical characteristics. This is particularly true with coils which are self-resonant at RF frequencies, such as those used in antenna tuning applications, wherein the distributed capacitance of the coil is relied on to form a resonant circuit and no variable tuning means are provided.

While injection molding techniques allow forms for such coils to be produced at greatly reduced cost, the technique has been generally successful only for coils having a very small diameter; i.e., approximately ½ inch or less. For coil forms of larger sizes, e.g., from approximately ½ to 3 or more inches in diameter, the uneven shrinkage of the plastic following the molding operation has prevented the formation of a surface capable of supporting and positioning windings with the necessary precision to ensure a consistent and predictable self-resonant frequency. The problem is compounded in applications such as the aforementioned antenna tuning application wherein the coil form must, in addition to being dimensionally accurate, be capable of withstanding extreme temperature variations and repeated mechanical stresses.

It is therefore an object of the present invention to provide a new and improved injection-molded coil form having a high precision surface for supporting and positioning windings.

It is another object of the invention to provide a coil form having a precision surface for receiving windings which can be economically formed from plastic by injection-molding techniques.

It is another object of the invention to provide a high precision injected-molded coil form which offers improved resistance to temperature changes and mechanical stress.

SUMMARY OF THE INVENTION

The invention is directed to a high-precision coil form for supporting an inductance winding. The coil comprises a cylindrical core member having a relatively low-precision circumferential surface thereon of slightly smaller diameter than the winding, and a thin plastic layer molded to the surface of the core member, this layer having a surface of relatively high dimensional precision for supporting and positioning the inductance winding.

BRIEF DESCRIPTION OF THE DRAWINGS

The features of the present invention, which are believed to be novel, are set forth with particularity in the appended claims. The invention, together with the further objects and advantages thereof, may best be understood by reference to the following description taken in connection with the accompanying drawings, in the several figures of which like reference numerals identify like elements, and in which:

DESCRIPTION OF THE PREFERRED EMBODIMENT

Figure 1:
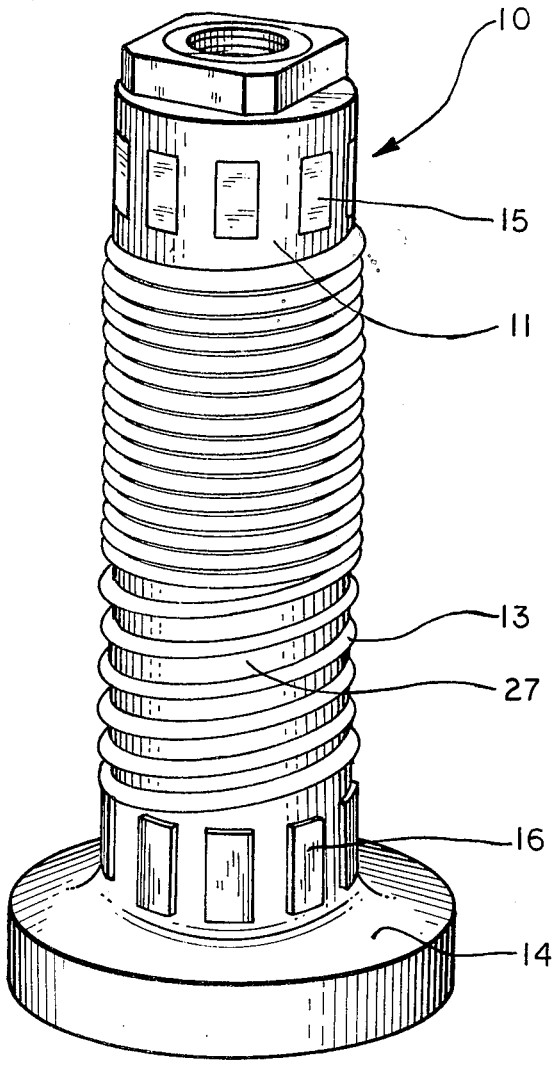
FIG. 1 is a perspective view of an inductance coil assembly incorporating a precision injection-molded coil form constructed in accordance with the present invention.

Referring now to the drawings, and particularly to FIG. 1, there is shown an inductance coil assembly 10 constructed in accordance with the invention for use in electrically matching a coaxial feed line to a whip antenna. The coil assembly includes a central cylindrically-shaped coil form 11 on the circumferential surface of which a helical groove 12 (FIG. 2) is provided for receiving an electrical conductor 13 comprising the winding of the coil. A flanged base portion 14 is provided at the bottom end of the coil form assembly and a plurality of electrically conductive contact surfaces 15 and 16 are provided at the top and bottom ends of the form assembly, respectively, for establishing electrical contact with and anchoring the ends of conductor 13.

Figure 2:
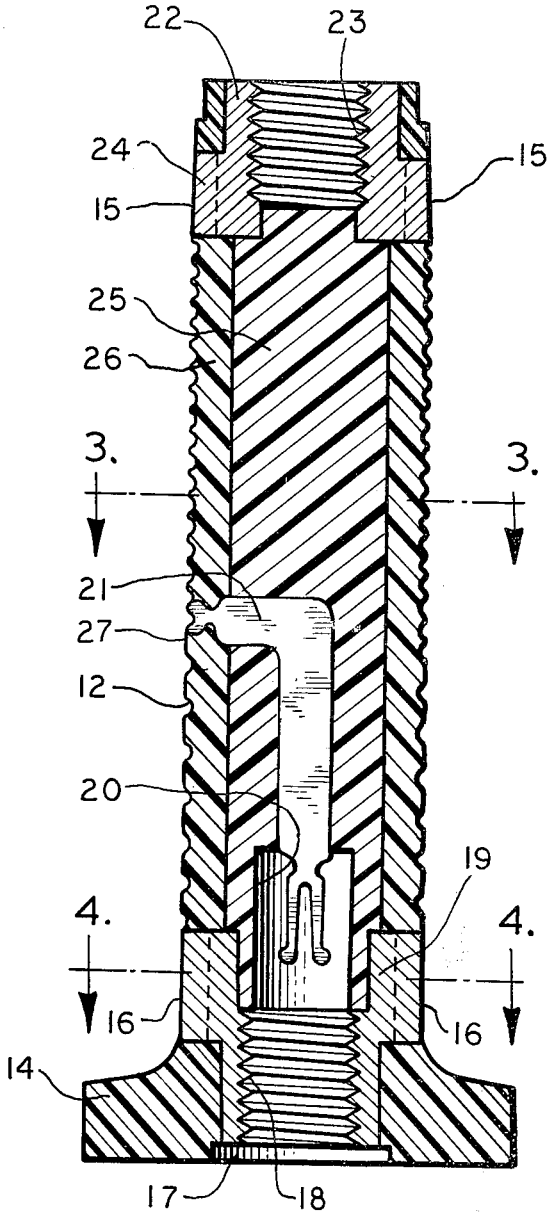
FIG. 2 is a cross-sectional view of the coil form shown in FIG. 1 taken along line 2—2 of FIG. 1.

Referring to FIG. 2, to facilitate mounting the coil assembly 10 to an underlying surface the bottom end of form 11 includes an axially-aligned end fitting 17. This fitting includes a bore 18 which is partially threaded to receive a belt (not shown) from the underlying surface, and a plurality of radially-extending tab portions 19 which anchor the fitting in place and form on their exposed surfaces the contacts 15 utilized to establish electrical connection with conductor 13. In the illustrative loading coil embodiment this establishes electrical contact between the underlying surface, representing ground, and the bottom end of the winding. To establish electrical contact with an intermediate tap on the coil a flat contact member 21 in the form of an inverted "L" may be embedded into coil form 11. The radially-extending end of this contact member is notched to receive conductor 13 at a predetermined desired location along the coil, and the axially-extending end is forked to receive a sleeve-type push-on electrical connector (not shown) of conventional design and construction. Bore 18 may include a portion 20 extending upwardly along the axis to the coil form for the purpose of accommodating this connector.

The top end of the coil form 11 includes an axially-aligned end fitting 22 having a threaded bore 23 for receiving the threaded bottom end of the whip antenna. Like end fitting 17, this fitting includes a plurality of radially-extending tab portions 24 for anchoring the fitting in place and for forming the contact surfaces 15 for establishing electrical contact with conductor 13. In the illustrated embodiment these contact surfaces establish an electrical connection between the whip antenna and the top end of the wiring 13.

Figure 3:
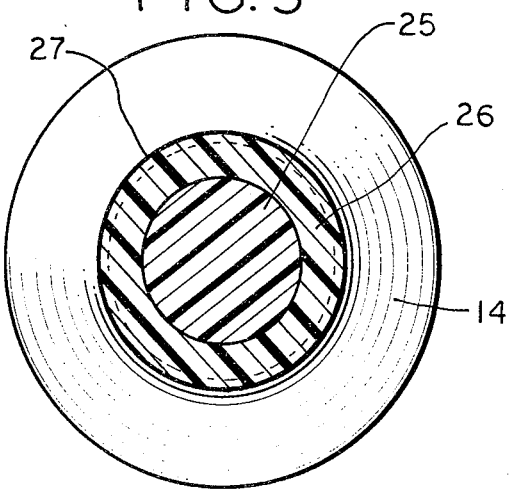
FIG. 3 is an enlarged cross-sectional view taken along line 3—3 of FIG. 2.
Figure 4:
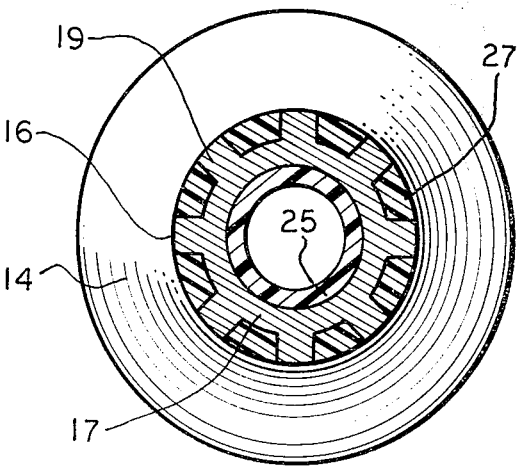
FIG. 4 is an enlarged cross-sectional view taken along line 4—4 of FIG. 2.
Figure 5:
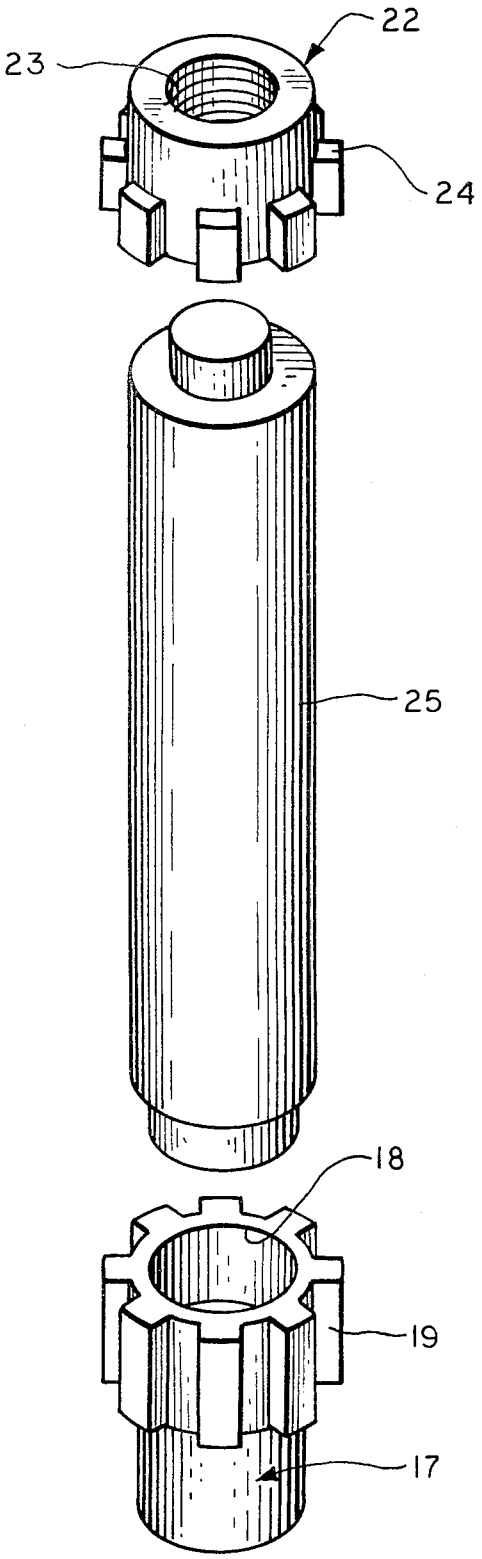
FIG. 5 is an exploded assembly view of the core and end fittings of the injection-molded coil form.
Figure 6:
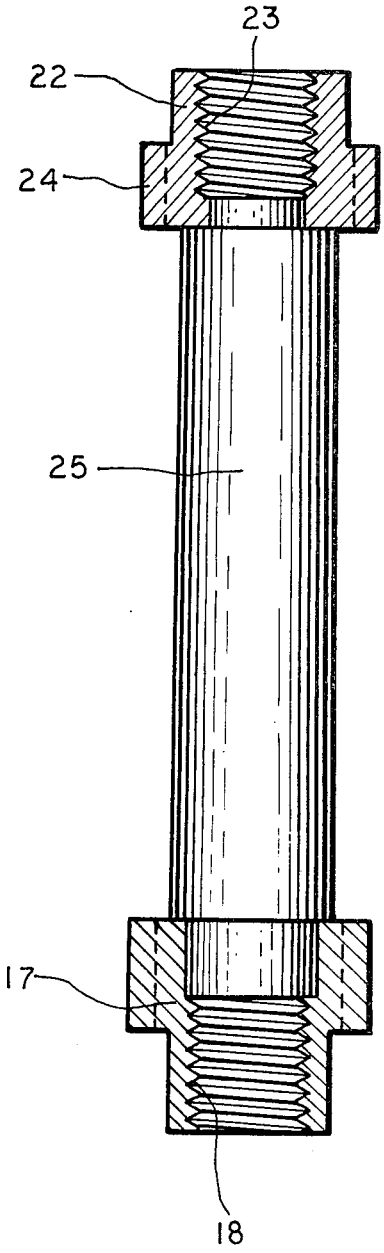
FIG. 6 is a perspective view partially in cross-section of the core and end fittings in an assembled state.

In accordance with the invention, the coil form 11, as seen in FIGS. 2–4, includes a central core 25 of generally cylindrical form and relatively imprecise dimensions which may be molded of a material such as plastic, and a thin layer 26 around the circumference of the core which may also be molded of plastic. Layer 26 forms a surface 27 of precision dimensions on which groove 12 is formed for positioning and supporting the coil winding 13. The core 25 is dimensioned to be of just slightly smaller diameter than that of coil form 11 so that the structure of the core forms the greater part of the completed coil form. Typically, in a core approximately 1 inch in diameter, a difference of approximately 0.200 inch may be provided between the diameter of the core and the diameter of the completed coil form so that the thickness of the plastic overmold layer will be approximately 0.100 inch or less. Providing a layer of this thickness over the relatively large pre-molded core avoids the dimensional variations which would result if the coil form were formed in a single molding operation since only the thin overmolded layer is subject to shrinkage during formation of the surface which supports conductor 13, and not the entire core diameter.

In forming the plastic overmold layer a previously molded core having a diameter slightly less than the desired coil diameter and of relatively low precision is positioned in a high precision mold (not shown) having interior cavity dimensions corresponding to the exact outside dimensions desired for the coil form being produced. Plastic is then injected into the mold to fill the void between the relatively low-precision surface of the core and the high-precision surfaces of the mold cavity. The resulting plastic layer is then allowed to cure or set, thereby bonding itself to the core to form the low-cost high-precision coil form contemplated by the invention.

In practice the outer surface 13 of the plastic overmold layer 12 may be formed within a tolerance of ±0.001 inch with overmold layers not exceeding approximately 0.100 inch in thickness. If the entire coil form had been molded as a homogeneous plastic structure, an outer surface of this precision would be very difficult to obtain because of the uneven shrinkage properties of the molded plastic.

While a single embodiment of the invention has been shown and described, it will be obvious to those skilled in the art that changes and modifications may be made without departing from the invention in its broader aspect. Therefore, the aim in the appended claims is to cover all such changes and modifications as fall within the true spirit and scope of the invention.

I claim:

1. A precision inductance winding assembly comprising, in combination:

a generally cylindrical core member having an axially-extending circumferential surface and a shank portion of reduced diameter at one end;

an electrical conductor formed into an inductance winding configuration having a diameter overall slightly greater than the diameter of said core member;

annular positioning means for said electrical conductor including a layer of dielectric material permanently molded in support-receiving relationship on the surface of said core member and extending into engagement with said conductor for maintaining said electrical conductor in said inductance winding configuration; and mounting means including a one-piece electrically-conductive end fitting having a radially-extending contact portion electrically connected to said conductor and an axially-extending mounting portion for attachment to an external member, said contact portion being discontinuous about the circumference of said fitting to form a plurality of radially-extending tab portions, and said end fitting being fitted over said shank portion with said contact portion at least partially embedded in said positioning layer and said positioning layer extending between said tab portions to secure said fitting in abutting relationship to said core member.

2. A precision inductance winding assembly as defined by claim 1 wherein said core member includes a shank portion of reduced diameter at its other end, and wherein said mounting means include a pair of said end fittings, one of said fittings being disposed over the shank at one end of said core member for mounting said coil form to an underlying surface, and the other of said fittings being disposed over the shank at the other end of said core member to mount said coil form to an associated antenna.

3. A precision inductance winding assembly comprising, in combination:

a substantially solid generally cylindrical injection molded plastic core member having an axially-extending circumferential surface including undesired diametric variation occurring as a result of post-molding cooling of said core member, and a shank portion of reduced diameter at one end;

an electrical conductor formed into an inductance winding configuration having a diameter overall slightly greater than the diameter of said core member;

annular positioning means for said electrical conductor including a layer of dielectric material permanently molded in support-receiving relationship on the surface of said core member and extending into engagement with said conductor for maintaining said electrical conductor in said inductance winding configuration notwithstanding said diametric variation in said circumferential surface; and mounting means including a one-piece electrically-conductive end fitting having a radially-extending contact portion electrically connected to said conductor and an axially-extending mounting portion for attachment to an external member, said end fitting being fitted over said shank portion with said contact portion at least partially embedded in said positioning layer to secure said fitting in abutting relationship to said core member, said contact portion being discontinuous about the circumference of said fitting to form a plurality of radially-extending tab portions, and said positioning layer extends between said tab portions to secure said end fitting in position.

* * * * *